United States Patent [19]

Bland

[11] Patent Number: 4,753,442

[45] Date of Patent: Jun. 28, 1988

[54] BASEBALL GLOVE WITH AUTOMATIC BALL RETURN DEVICE

[76] Inventor: Clyde S. W. Bland, 240 Serpentine Dr., Bayville, N.J. 08721

[21] Appl. No.: 39,981

[22] Filed: Apr. 20, 1987

[51] Int. Cl.[4] ..... A63B 41/00; A63B 69/00

[52] U.S. Cl. ..... 273/414; 273/26 E; 273/58 C; 273/320; 273/330

[58] Field of Search ..... 273/414, 412, 413, 58 C, 273/184 B, 185 C, 185 D, 196, 198, 200 R, 200 B, 26 E, 26 EA, 319, 320, 321, 329, 330, 331, 332, 333, 334, 335

[56] References Cited

U.S. PATENT DOCUMENTS

| | | | |
|---|---|---|---|
| 2,941,805 | 6/1960 | Chupa | 273/58 C |
| 3,135,537 | 10/1964 | Lewis | 273/412 |
| 3,168,312 | 2/1965 | Davis | 273/58 C X |
| 3,191,880 | 6/1975 | Visconti | 273/200 R X |
| 3,655,190 | 4/1972 | Lemon | 273/414 |
| 3,731,927 | 5/1973 | Rocco, Jr. | 273/58 C X |
| 3,843,126 | 10/1974 | Bandy | 273/414 |
| 3,953,030 | 4/1976 | Muchnick | 273/412 X |
| 4,601,474 | 7/1986 | Lew et al. | 273/414 |

FOREIGN PATENT DOCUMENTS 2113601 9/1972 Fed. Rep. of Germany .... 273/58 C

*Primary Examiner*—William H. Grieb

*Attorney, Agent, or Firm*—Klauber & Jackson

[57] ABSTRACT

An automatic ball return device for use with a baseball glove to be worn by a person, includes a housing mounted on the rear portion of the baseball glove; a spool rotatably mounted in the housing; a cord wound on the spool and having a free end extending through the webbing of the glove to the front pocket thereof and connected thereat to a ball; a motor for winding the cord onto the spool; a clutch for engaging the motor with the spool to cause the motor to wind the cord onto the spool; and a switch which controls the motor and the clutch to permit free rotation of the spool to enable the cord to freely unwind with minimal resistance from the spool when the ball is thrown, and to cause the motor to wind the cord onto the spool upon actuation of the switch after the ball has been thrown, after a predetermined amount of time, or after the cord has unwound a predetermined extent.

31 Claims, 4 Drawing Sheets

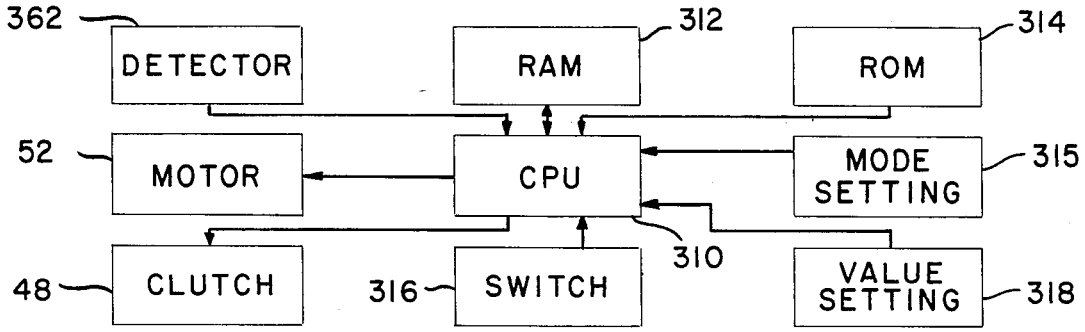
FIG. 9
FIG. 10
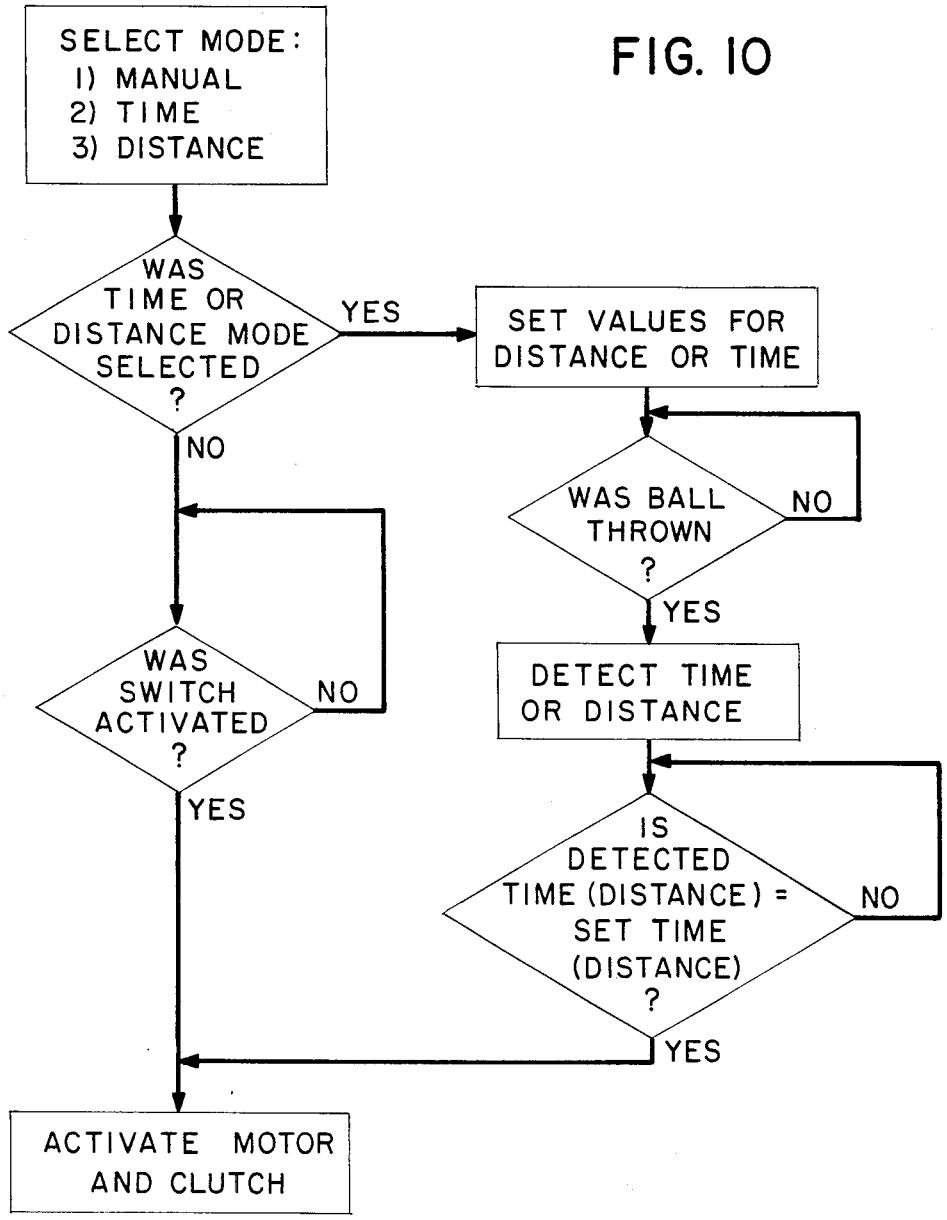

BASEBALL GLOVE WITH AUTOMATIC BALL RETURN DEVICE

BACKGROUND OF THE INVENTION

This invention relates generally to the sport of baseball, and more particularly, is directed to a baseball glove having a device for automatically returning the ball to the pocket of the baseball glove.

Since Abner Doubleday invented the sport of baseball, baseball has grown to be the national sport of the United States. In this regard, organized baseball exists today in the United States for all ages, and particularly for children, starting at the age of six years old in the form of Little League. Because of the great popularity of the sport, children throughout the United States continually play and practice throwing, catching and hitting a baseball.

However, oftentimes a child can not find a partner to have a catch with. Therefore, the child becomes frustrated. Although the child can practice throwing the ball by himself, he must then chase the ball to recover it. The child then becomes bored and stops practicing.

Various devices are known in which a ball is tethered to a baseball glove or the like to permit the ball to be easily returned. Devices of this type are disclosed in U.S. Pat. Nos. 3,153,587; 8,781,927; and 3,843,126. Although some of these devices include elastic bands for securing the ball to the glove, full return of the ball into the glove pocket does not occur after the ball is thrown. Therefore, the child must pull in the ball by the tether line, which may require removal of the glove from the child's hand. This again becomes tiresome so that the child may become bored and stop practicing.

U.S. Pat. No. 3,655,190 discloses a tethered ball, with the opposite end of the string wound on a reel at the back of the person's hand. However, the ball is not meant to be thrown, but only swung, since the wire thereof pinches the string to fix it in place. Even so, this device does not provide an automatic winding device for a ball return.

U.S. Pat. No. 4,601,474 does disclose a winding device for a tethered ball. However, the winding device is in the ball itself and, in any event, is not associated with a baseball glove. Rather, the device is used in much the same manner as a medieval mace, that is, as a defensive weapon. In addition, the winding device is comprised of torsion springs. This means that, as the ball is thrown, the springs constantly apply an increasing resisting force thereto, and once the force on the ball reduces to a level, after being thrown, less than that applied by the torsion springs, the ball automatically returns. This device could therefore not be used for throwing a ball a substantial distance.

OBJECTS AND SUMMARY OF THE INVENTION

Accordingly, it is an object of the present invention to provide a baseball glove with an automatic ball return device that automatically returns the ball to the pocket of the glove.

It is another object of the present invention to provide an automatic ball return device for use with a baseball glove which permits free throwing of a baseball with a minimum resisting force thereto.

It is still another object of the present invention to provide an automatic ball return device for use with a baseball glove which provides for automatic return of the ball into the pocket of the baseball glove after the ball has been thrown a desired distance.

It is yet another objection of the present invention to provide an automatic ball return device for use with a baseball glove that automatically returns the ball to the pocket of the glove after a predetermined time period.

It is a further object of the present invention to provide an automatic ball return device for use with a baseball glove that automatically returns the ball to the pocket of the baseball glove upon actuation of a switch by the user.

It is a still further object of the present invention to provide an automatic ball return device of the above type that is removably secured to the rear portion of a baseball glove.

In accordance with an aspect of the present invention, a ball return device for use with a baseball glove to be worn by a person, includes a housing; a spool rotatably mounted in the housing; cord means wound on the spool and having a free end for attachment to a ball; motor means for winding the cord means onto the spool; and control means for controlling the motor means to permit free rotation of the spool so as to enable the cord means to freely unwind from the spool when the ball is thrown, and to cause the motor means to wind the cord means onto the spool after the ball has been thrown.

In accordance with another aspect of the present invention, an amusement apparatus includes a baseball glove having webbing defining a front pocket for catching the ball, a glove portion through which a person's hand extends, and a rear portion; and a ball return device mounted on the rear portion of the baseball glove, the device including a housing mounted on the rear portion of the baseball glove; a spool rotatably mounted in the housing; cord means wound on the spool and having a free end for attachment to a ball; motor means for winding the cord means onto the spool; and control means for controlling the motor means to permit free rotation of the spool so as to enable the cord means to freely unwind from the spool when the ball is thrown, and to cause the motor means to wind the cord means onto the spool after the ball has been thrown.

The above and other objects, features and advantages of the present invention will become readily apparent from the following detailed description thereof which is to be read in connection with the accompanying drawings.

BRIEF DESCRIPTION OF THE DRAWINGS

FIG. 9 is a block diagram of alternative circuitry for the ball return device according to another embodiment of the present invention; and FIG. 10 is a flow chart diagram used for illustrating operation of the circuitry of FIG. 9.

DETAILED DESCRIPTION OF THE PREFERRED EMBODIMENTS

Figure 1:
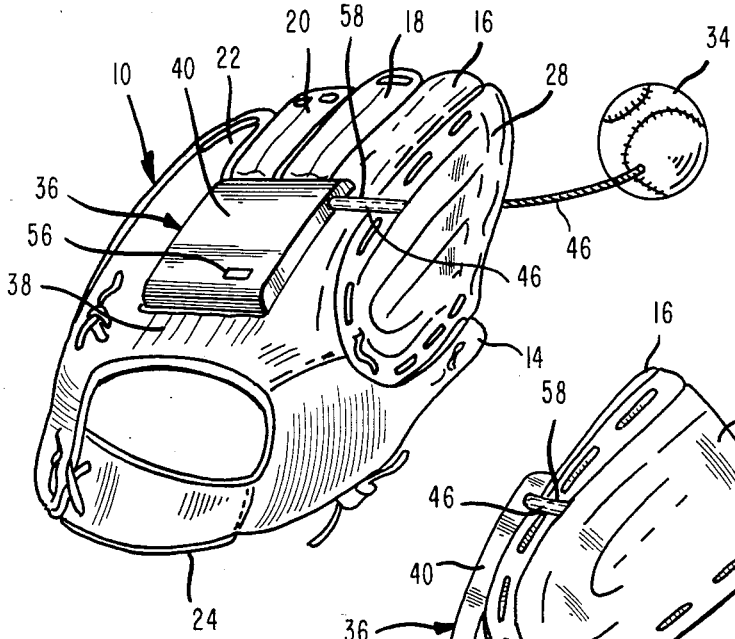
FIG. 1 is a rear perspective view of a baseball glove with a ball return device according to the present invention secured thereon.
Figure 2:
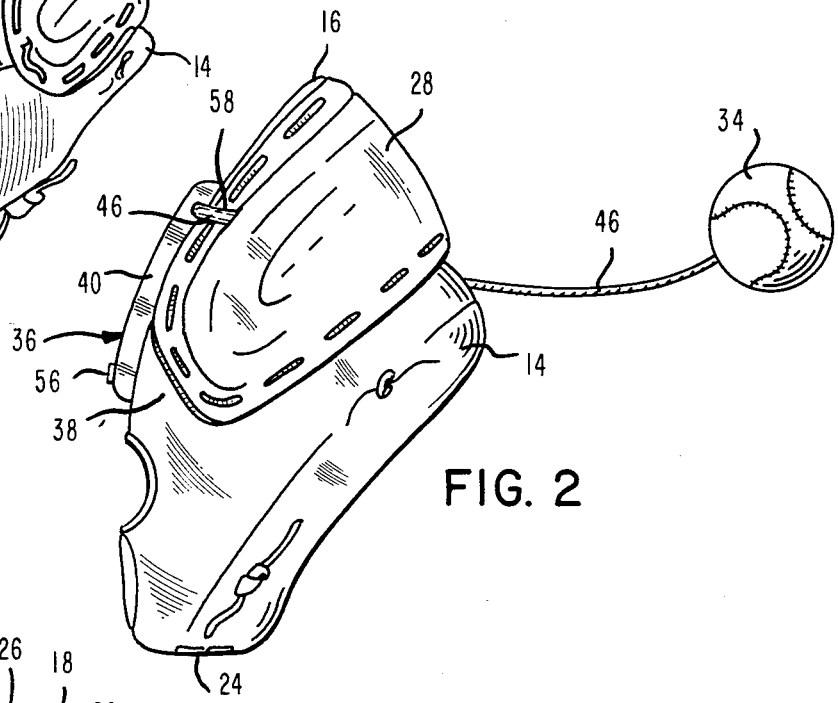
FIG. 2 is a side elevational view of the baseball glove and ball return device of FIG. 1.
Figure 3:
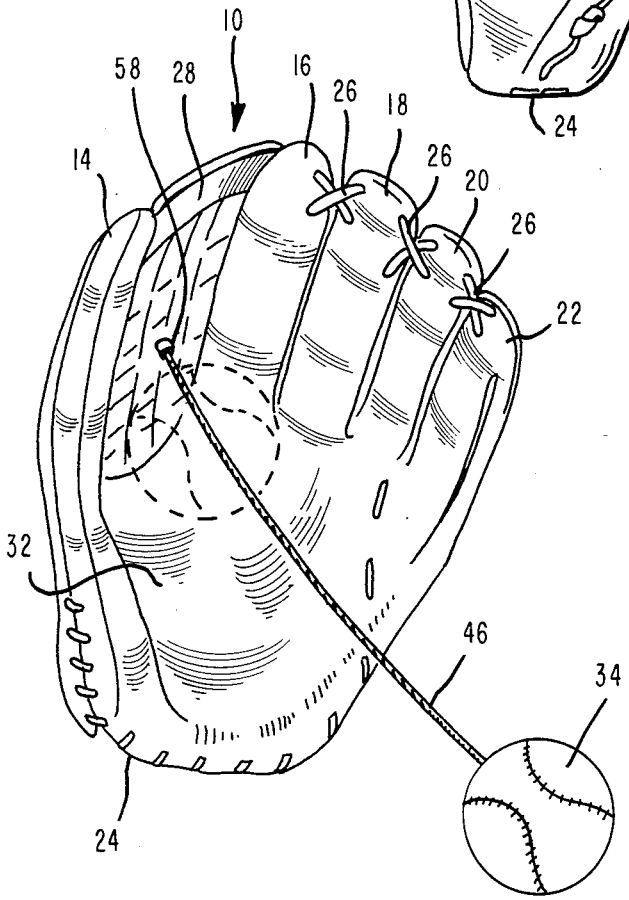
FIG. 3 is a front perspective view of the baseball glove and ball return device of FIG. 1.

Referring to the drawings in detail, and initially to FIGS. 1–3 thereof, there is shown a baseball glove 10 including a plurality of finger portions 14, 16, 18, 20 and 22 accessible through an end opening 24 and through which the user inserts his fingers for holding glove 10 on his hand. Stitching 26 is provided for securing finger portions 16, 18, 20 and 22 together, while webbing 28 is provided for securing finger portions 14 and 16 together, webbing 28 defining a pocket 30 along with the front portion 32 of glove 10 which is adapted to receive a ball 34 for catching the same. The above description of a baseball glove is conventional.

Figure 4:
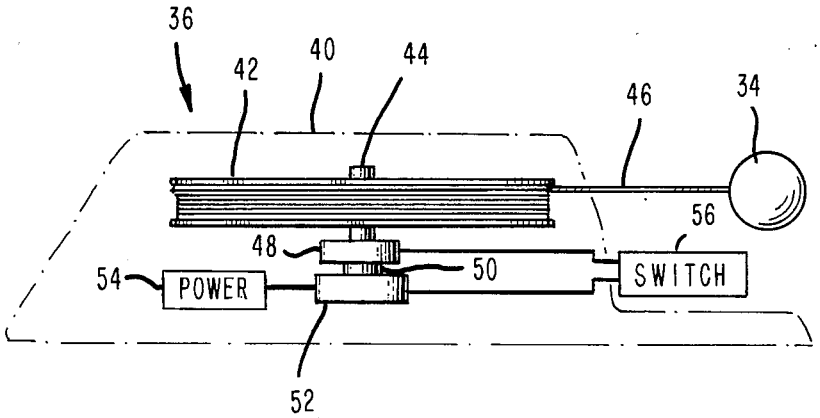
FIG. 4 is a schematic view of the ball return device of FIG. 1.

In accordance with the present invention, an automatic ball return device 36 is mounted to the rear portion 38 of baseball glove 10. Automatic ball return device 36, as best shown in FIGS. 1 and 4, includes a housing 40 fixedly secured to rear portion 38 of baseball glove 10. Housing 40 can be any suitable housing made of, for example, plastic, but should be relatively thin, and somewhat flexible. so as not to interfere with the operation of baseball glove 10. In this regard, housing 40 should preferably be positioned at the center of rear portion 38.

A spool 42 is mounted on a shaft 44 within housing 40 and has a cord 46 wound thereabout, one end of cord 46 being secured to spool 42 and the opposite, free end of cord 46 being secured to ball 34 by any suitable means. In this regard, cord 46 extends from a spool 42, through an opening in housing 40, and then through the rear portion of webbing 28 to pocket 30, where it is secured to ball 34. As an example of a way that cord 46 can be secured to ball 34, cord 46 can extend through ball 34 and be tied around ball 34. Alternatively, the free end of cord 46 can have an enlarged end positioned within the center of ball 34 to prevent escape of cord 46 from ball 34. Cord 46 is preferably a thin line cord, such as a nylon cord, which has sufficient strength to withstand the forces occurring during operation of the present invention when ball 34 is being thrown and retrieved, while also being of a sufficiently small diameter to enable a sufficient length of cord 46 to be wound on spool 42 so as to permit ball 34 to be thrown a sufficient distance.

Shaft 44 is connected to a clutch 48 which, in turn, is connected to the output shaft 50 of an electric motor 52, the latter being energized by power means 54, such as a battery or the like. Motor 52 is fixed to an inner wall of housing 40. A switch 56 is mounted to the outside of housing 40 and is connected to clutch 48 and motor 52 to control operation thereof.

During a normal throwing operation, clutch 48 disengages shaft 44 from output shaft 50 of motor 52. Accordingly, shaft 44, and thereby spool 42 are freely rotatable. This permits ball 34 to be thrown without any resistance from clutch 48 and motor 52. This is directly contrary to the teachings of U.S. Pat. No. 4,601,474 in which the resistance increases as the line is drawn out. Once ball 34 has landed, the person merely depresses switch 56, which activates clutch 48 and motor 52. As a result, motor 52 is driven, and clutch 48 connects output shaft 50 of motor 52 with shaft 44. This causes shaft 44 and spool 42 to rotate, thereby winding cord 46 about spool 42, and thereby pulling ball 34 back to the user.

Of course, any motor 52 that permits free rotation of spool when the motor is inactive and which will wind spool 42 when activated, can be used. In such case, clutch 48 could be eliminated, and output shaft 50 of motor 52 would constitute shaft 44 on which spool 42 is mounted.

In accordance with the present invention, as shown in FIGS. 1 and 2, a plastic tube 58 is connected to housing 40 at the position where cord 46 escapes therefrom. Plastic tube 58 has an end which projects slightly through webbing 28. Because of the curved nature of plastic tube 58, cord 46 has less resistance than it would if it merely extended through webbing 28, that is, plastic tube 58 functions as a reduced friction guide for cord 46. Thus, when the person throws ball 34, cord 46 has less of a resistance force applied thereto to permit easier throwing of ball 34.

Thus, with the present invention, a child can practice throwing a ball by himself. Specifically, ball 34 can be easily thrown by the child with little resistance to such throwing action. To return the ball, the child merely depresses switch 56 which causes motor 52 to automatically rewind cord 46 onto spool 42, thereby pulling ball 34 directly into pocket 30 of baseball glove 10. Then, the operation can be repeated.

Figure 5:
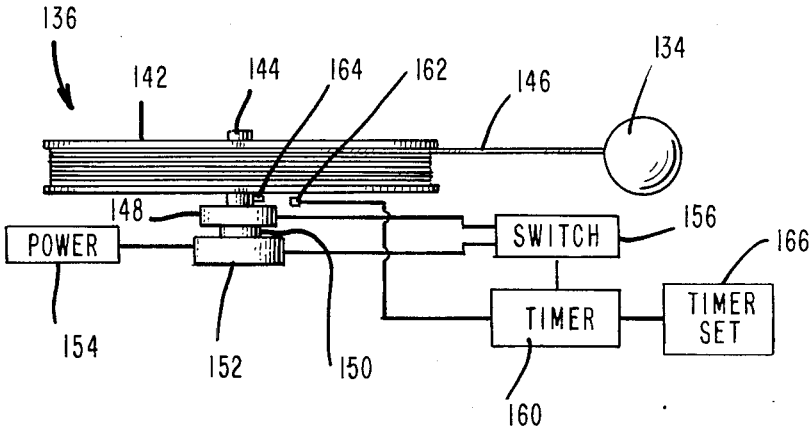
FIG. 5 is a schematic view of a ball return device according to another embodiment of the present invention.

Referring now to FIG. 5, an automatic ball return device 136 according to another embodiment of the present invention will now be described, in which elements corresponding to those described in the embodiment of FIG. 4 are identified by the same reference numerals augmented by 100, and a detailed description thereof will be omitted herein for the sake of brevity. In the embodiment of FIG. 5, a timer 160 is electrically connected to switch 156 and ie mounted within the housing. Timer i60 is connected with a detector 162 positioned in opposing relation to an actuator 164 mounted to shaft 144. Detector 162 can be a Hall-effect element, phototransistor or the like. When shaft 144 starts rotating, which corresponds to ball 134 being thrown, detector 162 supplies a signal to timer 160. Timer 160 then counts a certain time period, as set by the user with a timer set device 166 connected to timer 160. For example, a dial or the like can be provided on the housing as a timer set device 166. After the time period set by timer set device 166 has elapsed, timer 160 automatically activates switch 156 which, in turn, activates clutch 148 and motor 152 to automatically rewind cord 146 onto spool 142. For example, timer 160 can be set to count for three seconds. Depending upon the age of the user, the ball will travel different distances during such three second time period and the user can thereafter adjust timer set device 166 accordingly until the desired distance is obtained.

Figure 6:
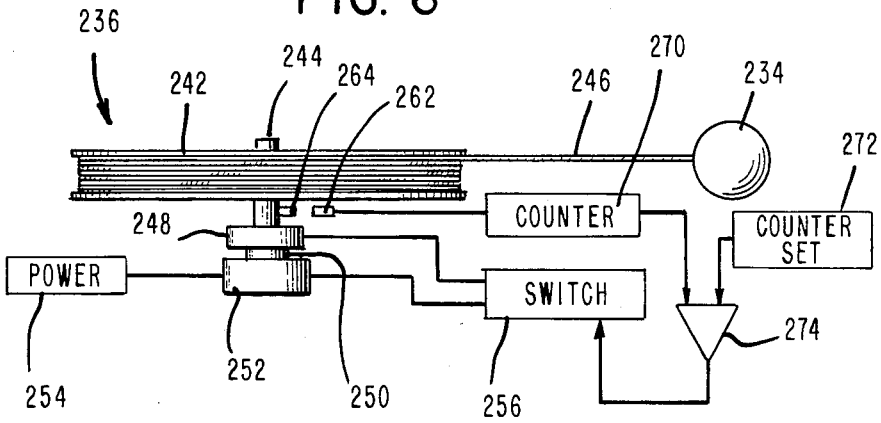
FIG. 6 is a schematic view of a ball return device according to still another embodiment of the present invention.

Referring now to FIG. 6, an automatic ball return device 236 according to another embodiment of the present invention will now be described, in which elements corresponding to those described in the apparatus of FIG. 5 are identified by the same reference numerals augmented by 100, and a detailed description thereof will be omitted herein for the sake of brevity. In place of timer 160 and timer set device 166, the embodiment of FIG. 6 is provided with a counter 270 and a counter set device 272. Counter 270 is connected with detector 262 which, in accordance with rotation of shaft 244, and thereby actuator 264, sends a signal to counter 270 for each rotation of shaft 244. Counter 270 thereby counts the number of rotations of shaft 244 and produces an output count signal in response thereto. The output of counter 270 is supplied to a comparator 274, along with a predetermined count signal from a counter set device 272 set by the user. Comparator 274 compares the two signals from counter 270 and counter set device 272, and when the two signals are equal, supplies an actuation signal to switch 256 to cause the latter to control clutch 248 and motor 252 to rotate spool 242, so as to rewind cord 262 onto spool 242 and return ball 234 to the pocket of the baseball glove.

Thus, with the embodiment of FIG. 6, after cord 246 has unwound a predetermined distance from spool 242, clutch 248 and motor 252 are automatically activated to return ball 234 to the pocket of the baseball glove. In this regard, a chart can be provided to indicate settings of counter set device 272 that correspond to different distances.

Figure 7:
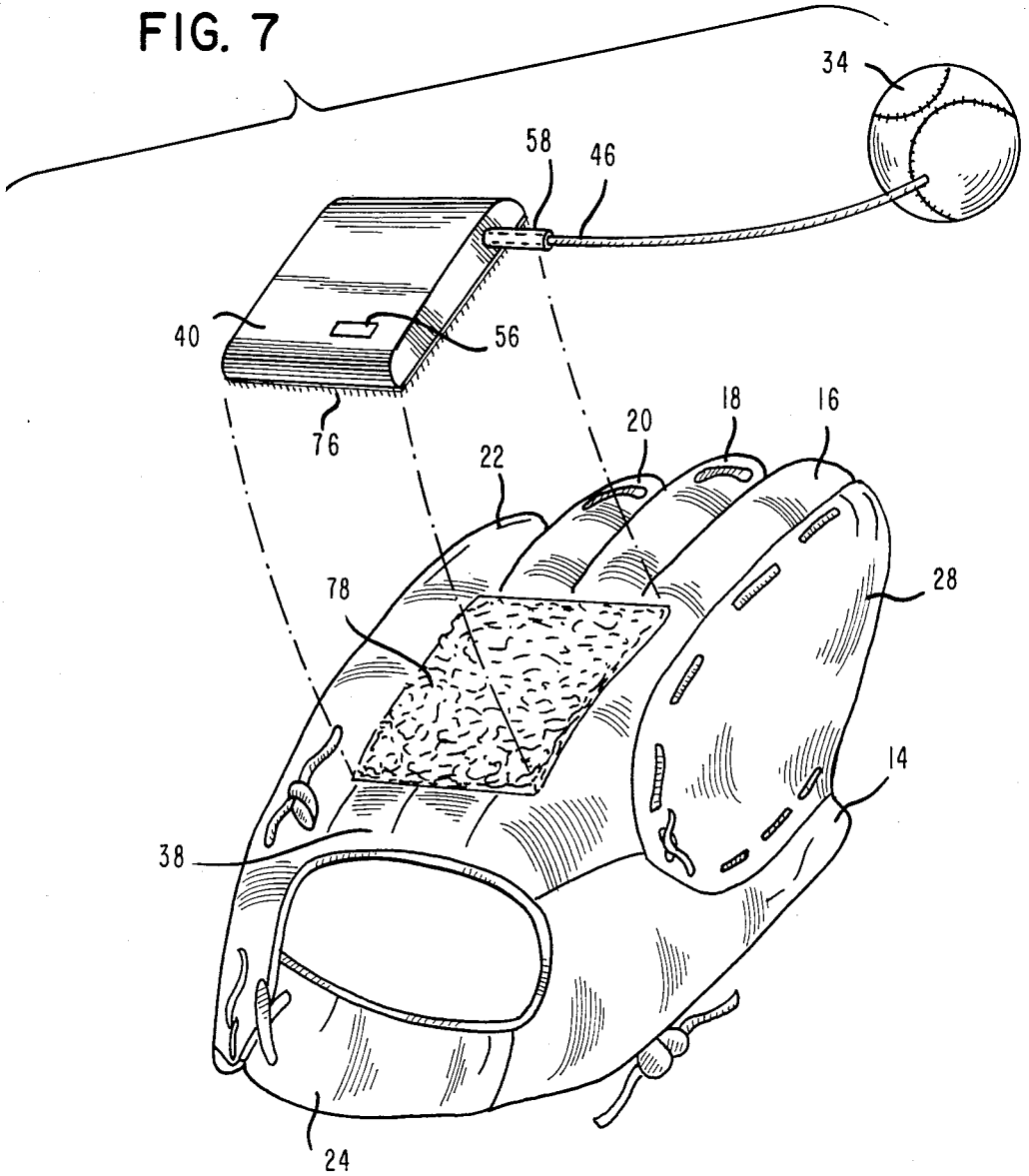
FIG. 7 is a rear perspective view of a baseball glove and ball return device according to another embodiment of the present invention.
Figure 8:
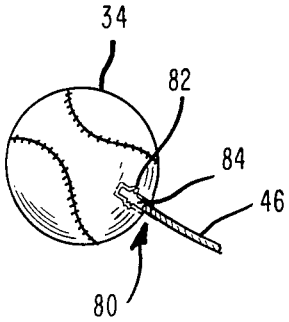
FIG. 8 is a plan view, partially in phantom, showing attachment of the cord to the baseball.

Referring now to FIGS. 7 and 8, it will be seen that housing 40 can be removably mounted on the rear portion 38 of baseball glove 10. Specifically, housing 40 and rear portion 38 of baseball glove 10 can be provided with corresponding "Velcro" fabrics 76 and 78, respectively, to permit housing 40 to be removably secured on rear portion 38 of baseball glove 10, as shown. With such arrangement, it is also necessary to provide cord 46 with a coupling device 80 to permit ball 34 to be disengaged from cord 46. For example, coupling device 80 can include two screwthreaded elements 82 and 84, element 82 secured within ball 34 and having internal screw threads, and element 84 connected to the free end of cord 46 and having external screw threads adapted to screw-threadedly engage within element 82, and therefore, within ball 34. In this manner, coupling device 80 does not interfere with operation of the present invention.

Thus, to assemble the invention of FIG. 7, housing 40 is secured by "Velcro" fabrics 76 and 78 to rear portion 38 of baseball glove 10. The free end of cord 46 is then pulled through webbing 28 of baseball glove 10 to the front portion thereof, and elements 82 and 84 are screwthreaded together. To disassemble automatic ball return device 36, the reverse steps are performed.

It will therefore be appreciated that, with the present invention, automatic ball return devices 36, 136 and 236 permit free throw of the ball with minimal resistance to such throwing action, and provide for automatic motorized return of the ball into the pocket of the baseball glove, (a) upon actuation of a switch, (b) after a certain time period or (c) after withdrawal of the cord by a certain amount.

It will be appreciated that the present invention is not limited for use in a throwing operation. For example, the present invention can be used where one child pitches the ball to another child who hits the ball with a bat. To retrieve the ball, the pitcher merely depresses switch 56, as aforesaid. Also, the present invention can be used other than with a baseball glove, for example, with a batting tee or the like.

Further, although the control means for the electric motor has been described as a switch that is actuated by the user, a timer or a comparator, it will be appreciated that the present invention is not so limited. For example, a micro-computer on a small chip could be used to accurately control energization of the motor and engagement of the clutch.

In this regard, reference is now made to FIGS. 9 and 10. As shown in FIG. 9, a central processing unit (CPU) 310 is provided in housing 40, and is connected to a random access memory (RAM) 312 which provides a work area for CPU 310 and a read only memory (ROM) 314 for storage of a program which controls the operation of CPU 310, as will be described hereinafter with regard to FIG. 10.

CPU 310, as controlled by the software in ROM 314, operates in three distinct modes, that is, a manual mode, a time mode and a distance mode. The mode is selected by a mode setting device 315, such as a mode setting knob.

The manual mode is the same as the operation described in FIG. 4, that is, a switch 316 which is the same as switch 56, is provided. When the mode is set to the manual mode by mode setting device 315 and when switch 316 is depressed, CPU 310 controls clutch 48 and motor 52 to rewind cord 46 onto spool 42.

The time mode is the same as that described with respect to the embodiment of FIG. 5. Thus, the mode setting device 315 is set to the time mode. Then, a time setting is set by the user by means of a value setting device 318 which functions in a similar manner to timer set device 166 of FIG. 5. Thus, value setting device 318 supplies a signal to CPU 310 corresponding to the desired time. A detector 362 which is identical to detector 162 of FIG. 5, supplies a signal to CPU 310 to indicate that ball 34 has been thrown. CPU 310 then counts the time from when ball 34 was first thrown, and compares this time to the time set by value setting device 318. When the two times are equal, CPU 310 automatically activates clutch 48 and motor 52 to rewind cord 46 onto spool 42.

The distance mode is the same as that described with respect to the embodiment of FIG. 6. Thus, the mode setting device 315 is set to the distance mode. Then, a distance setting is set by the user by means of value setting device 318 which functions in a similar manner to counter set device 272 of FIG. 6. Thus, value setting device 318 supplies a signal to CPU 310 corresponding to the desired distance. A detector 362 which is identical to detector 262 of FIG. 6, supplies a signal to CPU 310 to indicate that ball 34 has been thrown, and thereafter counts the number of rotations of shaft 44. CPU 310 then oompares this detected distance to the distance set by value setting device 318. When the two counts are equal, CPU 310 automatically activates clutch 48 and motor 52 to rewind cord 46 onto spool 42.

The above operation of the software that controls CPU 310 is summarized in the flow chart of FIG. 10.

Having described specific preferred embodiments of the invention with reference to the accompanying drawings, it will be appreciated that the present invention is not limited to those precise embodiments, and that various changes and modifications can be effected therein by one of ordinary skill in the art without departing from the spirit or scope of the invention as defined in the appended claims.

What is claimed is:

1. A ball return device for use with a baseball glove of the type having webbing defining a front pocket for catching a ball, a glove portion through which a person's hand extends, and a rear portion adjacent said webbing, said device comprising:

a housing;

a spool rotatably mounted in said housing;

cord means wound on said spool and having a free end for attachment to a ball;

electric motor means for winding said cord means onto said spool;

control means for controlling said motor means to permit free rotation of said spool so as to enable said cord means to freely unwind from said spool when said ball is thrown, and to cause said motor means to wind said cord means onto said spool after said ball has been thrown; and means for mounting said housing to said rear portion of the baseball glove.

2. A ball return device according to claim 1; further including clutch means for engaging said motor means with said spool to cause said motor means to wind said cord means onto said spool; and said control means controls said motor means and said clutch means to permit free rotation of said spool so as to enable said cord means to freely unwind from said spool when said ball is thrown, and to cause said motor means to wind said cord means onto said spool after said ball has been thrown.

3. A ball return device according to claim 2; wherein said control means includes switch means manually actuable by the person for controlling the motor means and the clutch means to permit free rotation of the spool to enable the cord means to freely unwind from the spool when the ball is being thrown, and to cause the motor means to wind said cord means onto said spool after said ball has been thrown.

4. A ball return device according to claim 1; wherein said housing is removably securable to a rear portion of the baseball glove.

5. A ball return device according to claim 1; wherein said cord means is detachably connected to said ball.

6. A ball return device for use with a baseball glove or the like, to be worn by a person, said device comprising:

a housing;

a spool rotatably mounted in said housing;

cord means wound on said spool and having a free end for attachment to a ball;

motor means for winding said cord means onto said spool;

control means for controlling said motor means to permit free rotation of said spool so as to enable said cord means to freely unwind from said spool when said ball is thrown, and to cause said motor means to wind said cord means onto said spool after said ball has been thrown, said control means including timer means for counting a predetermined time period after the ball has been thrown and for producing a signal at the end of said predetermined time period, and said motor means automatically winds the cord means onto the spool after the lapse of said predetermined time period, in response to the signal from said timer means.

7. A ball return device according to claim 6; wherein said control means further includes switch means for causing said motor means to automatically wind the cord means onto the spool after the lapse of said predetermined time period, in response to the signal from said timer means.

8. A ball return device according to claim 6; wherein said control means further includes timer set means connected to said timer means and actuable by the person to vary the predetermined time period.

9. A ball return device according to claim 6; wherein said control means further includes detector means for detecting when said ball is first thrown and for supplying a signal to said timer means to cause the latter to start counting said predetermined time period.

10. A ball return device for use with a baseball glove or the like, to be worn by a person, said device comprising:

a housing;

a spool rotatably mounted in said housing;

cord means wound on said spool and having a free end for attachment to a ball;

motor means for winding said cord means onto said spool;

control means for controlling said motor means to permit free rotation of said spool so as to enable said cord means to freely unwind from said spool when said ball is thrown, and to cause said motor means to wind said cord means onto said spool after said ball has been thrown, said control means including counter means for counting the number of rotations of said spool when said ball is being thrown and for producing a count signal in response thereto, and said motor means automatically winds the cord means onto the spool after the ball has been thrown, in response to the count signal from said counter means.

11. A ball return device according to claim 10; wherein said control means further includes counter set means actuable by the person for setting a predetermined count and for producing a count signal in response thereto, and comparator means for comparing the count signals of said counter set means and said counter means and for producing an actuation signal when said count signals are equal, and said motor means winds the cord means onto the spool after the ball has been thrown in response to the actuation signal.

12. A ball return device according to claim 11; wherein said control means further includes switch means for causing said motor means to automatically wind the cord means onto the spool in response to the actuation signal.

13. A ball return device according to claim 10; wherein said control means further includes detector means for detecting each rotation of said spool and for supplying a signal to said counter means after each rotation of said spool.

14. A ball return device for use with a baseball glove or the like, to be worn by a person, said device comprising:

a housing;

a spool rotatably mounted in said housing;

cord means wound on said spool and having a first end for attachment to a ball;

motor means for winding said cord means onto said spool;

control means for controlling said motor means to permit free rotation of said spool so as to enable said cord means to freely unwind from said spool when said ball is thrown, and to cause said motor means to wind said cord means onto said spool after said ball has been thrown, said control means including central processing means for controlling operation of said motor means.

15. A ball return device according to claim 14; wherein said control means further includes:

memory means for storing a program used by said central processing means;

mode setting means for controlling said central processing means to control operation of said motor means in a selected one of said modes; and value setting means for inputting a desired value when said central processing means controls operation of said motor means in said time mode and said distance mode.

16. An amusement apparatus comprising:

a baseball glove having webbing defining a front pocket for catching the ball, a glove portion through which a person's hand extends, and a rear portion adjacent said webbing; and a ball return device mounted on the rear portion of the baseball glove, said device comprising:

a housing mounted on the rear portion of the baseball glove;

a spool rotatably mounted in said housing;

cord means wound on said spool and having a free end for attachment to a ball;

electric motor means for winding said cord means onto said spool;

control means for controlling said motor means to permit free rotation of said spool so as to enable said cord means to freely unwind from said spool when said ball is thrown, and to cause said motor means to wind said cord means onto said spool after said ball has been thrown.

17. Apperatus according to claim 16; further including clutch means for engaging said motor means with said spool to cause said motor means to wind said cord means onto said spool; and said control means controls said motor means and said clutch means to permit free rotation of said spool so as to enable said cord means to freely unwind from said spool when said ball is thrown, and to cause said motor means to wind said cord means onto said spool after said ball has been thrown.

18. Apparatus according to claim 17; wherein said control means includes switch means manually actuable by the person for controlling the motor means and the clutch means to permit free rotation of the spool to enable the cord means to freely unwind from the spool when the ball is being thrown, and to cause the motor means to wind said cord means onto said spool after said ball has been thrown.

19. Apparatus according to claim 16; wherein said housing is removably securable to the rear portion of the baseball glove.

20. Apparatus according to claim 16; wherein said cord means is detachably connected to said ball.

21. Apparatus according to claim 16; further including reduced friction guide means for guiding said cord means from said housing through said webbing with reduced friction.

22. An amusement apparatus comprising:

a baseball glove having webbing defining a front pocket for catching the ball, a glove portion through which a person's hand extends, and a rear portion; and a ball return device mounted on the rear portion of the baseball glove, said device comprising:

a housing mounted on the rear portion of the baseball glove;

a spool rotatably mounted in said housing;

cord means wound on said spool and having a free end for attachment to a ball;

motor means for winding said cord means onto said spool;

control means for controlling said motor means to permit free rotation of said spool so as to enable said cord means to freely unwind from said spool when said ball is thrown, and to cause said motor means to wind said cord means onto said spool after said ball has been thrown, said control means including timer means for counting a predetermined time period after the ball has been thrown and for producing a signal at the end of said predetermined time period, and said motor means automatically winds the cord means onto the spool after the lapse of said predetermined time period, in response to the signal from said timer means.

23. Apparatus according to claim 22 wherein said control means further includes switch means for causing said motor means to automatically wind the cord means onto the spool after the lapse of said predetermined time period, in response to the signal from said timer means.

24. Apparatus according to claim 22 wherein said control means further includes timer set means connected to said timer means and actuable by the person to vary the predetermined time period.

25. Apparatus according to claim 22 wherein said control means further includes detector means for detecting when said ball is first thrown and for supplying a signal to said timer means to cause the latter to start counting said predetermined time period.

26. An amusement apparatus comprising:

a baseball glove having webbing defining a front pocket for catching the ball, a glove portion through which a person's hand extends, and a rear portion; and a ball return device mounted on the rear portion of the baseball glove, said device comprising:

a housing mounted on the rear portion of the baseball glove;

a spool rotatably mounted in said housing;

cord means wound on said spool and having a free end for attachment to a ball;

motor means for winding said cord means onto said spool;

control means for controlling said motor means to permit free rotation of said spool so as to enable said cord means to freely unwind from said spool when said ball is thrown, and to cause said motor means to wind said cord means onto said spool after said ball has been thrown, said control means including counter means for counting the number of rotations of said spool when said ball is being thrown and for producing a count signal in response thereto, and said motor means automatically winds the cord means onto the spool after the ball has been thrown, in response to the count signal from said counter means.

27. Apparatus according to claim 26; wherein said control means further includes counter set means actuable by the person for setting a predetermined count and for producing a count signal in response thereto, and comparator means for comparing the count signals of eaid counter set means and said counter means and for producing an actuation signal when said count signals are equal, and said motor means winds the cord means onto the spool after the ball has been thrown in response to the actuation signal.

28. Apparatus according to claim 26 wherein said control means further includes switch means for causing said motor means to automatically wind the cord means onto the spool in response to the actuation signal.

29. Apparatus according to claim 26 wherein said control means further includes detector means for detecting each rotation of said spool and for supplying a signal to said counter means after each rotation of said spool.

30. An amusement apparatus comprising:

a baseball glove having webbing defining a front pocket for catching the ball, a glove portion through which a person's hand extends, and a rear portion; and a ball return device mounted on the rear portion of the baseball glove, said device comprising:

a housing mounted on the rear portion of the baseball glove;

a spool rotatably mounted in said housing;

cord means wound on said spool and having a free end for attachment to a ball;

motor means for winding said cord means onto said spool;

control means for controlling said motor means to permit free rotation of said spool so as to enable said cord means to freely unwind from said spool when said ball is thrown, and to cause said motor means to wind said cord means onto said spool after said ball has been thrown, said control means including central processing means for controlling operation of said motor means.

31. A ball return device according to claim 30; wherein said control means further includes:

memory means for storing a program used by said central processing means;

mode setting means for controlling said central processing means to control operation of said motor means in a selected one of said modes; and value setting means for inputting a desired value when said central processing means controls operation of said motor means in said time mode and said distance mode.

* * * * *